US010343749B2

(12) United States Patent
Zhang et al.

(10) Patent No.: US 10,343,749 B2
(45) Date of Patent: Jul. 9, 2019

(54) SELF-BALANCING PRESSURE HULL DEVICE

(71) Applicant: JIANGSU UNIVERSITY OF SCIENCE AND TECHNOLOGY, Jiangsu (CN)

(72) Inventors: Jian Zhang, Jiangsu (CN); Tong Zhou, Jiangsu (CN); Wenxian Tang, Jiangsu (CN); Weiguang Zhang, Jiangsu (CN); Mige Dai, Jiangsu (CN); Bing Zhang, Jiangsu (CN); Saisai Feng, Jiangsu (CN); Shijie Su, Jiangsu (CN); Ben Zhang, Jiangsu (CN)

(73) Assignee: JIANGSU UNIVERSITY OF SCIENCE AND TECHNOLOGY, Jiangsu (CN)

( * ) Notice: Subject to any disclaimer, the term of this patent is extended or adjusted under 35 U.S.C. 154(b) by 0 days.

(21) Appl. No.: 15/752,586

(22) PCT Filed: Aug. 9, 2016

(86) PCT No.: PCT/CN2016/094256

§ 371 (c)(1),
(2) Date: Feb. 14, 2018

(87) PCT Pub. No.: WO2017/045494

PCT Pub. Date: Mar. 23, 2017

(65) Prior Publication Data

US 2018/0237108 A1 Aug. 23, 2018

(30) Foreign Application Priority Data

Sep. 15, 2015 (CN) ..... 2015 1 0586853

(51) Int. Cl.
*B63G 8/00* (2006.01)
*B63B 3/13* (2006.01)
(Continued)

(52) U.S. Cl.
CPC ..... *B63B 3/13* (2013.01); *B63G 8/001* (2013.01); *B63G 8/24* (2013.01); *B63G 8/26* (2013.01)

(58) Field of Classification Search
CPC .. B63B 3/13; B63G 8/00; B63G 8/001; B63G 8/24; B63G 2008/00; B63G 2008/001
(Continued)

(56) References Cited

U.S. PATENT DOCUMENTS 5,477,798 A * 12/1995 Ness ..... B63B 3/13 114/312
7,131,389 B1 * 11/2006 Hawkes ..... B63G 8/001 114/330

FOREIGN PATENT DOCUMENTS

CN 102556305 7/2012
CN 103241353 8/2013
(Continued)

OTHER PUBLICATIONS

"International Search Report (Form PCT/ISA/210)", dated Oct. 25, 2016, with English translation thereof, pp. 1-4.

*Primary Examiner* — Daniel V Venne
(74) *Attorney, Agent, or Firm* — JCIPRNET

(57) ABSTRACT

A self-balancing pressure hull device, belonging to the field of pressure structure technology of deep-sea submersibles, being assembled by nesting, from inside to outside, a spherical inner housing, a spherical intermediate housing and a spherical outer housing around the sphere center, pairs of symmetric coaxial connecting shaft components being connected between the spherical inner housing and the spherical intermediate housing and between the spherical intermediate housing and the spherical outer housing, respectively; axes of the two pairs of connecting shaft components are perpendicular to each other so as to enable the spherical inner housing and the spherical intermediate
(Continued)

housing to rotate relative to each other, and the spherical intermediate housing and the spherical outer housing to rotate relative to each other, and each of the connecting shaft components in the two pairs being provided with a spring damper for resisting the axial impact between each two adjacent housings.

18 Claims, 9 Drawing Sheets

(51) Int. Cl.
*B63G 8/26* (2006.01)
*B63G 8/24* (2006.01)

(58) Field of Classification Search
USPC ..... 114/312, 313, 320, 342
See application file for complete search history.

(56) References Cited

FOREIGN PATENT DOCUMENTS

| | | |
|---|---|---|
| CN | 203623913 | 6/2014 |
| DE | 102005047805 | 4/2006 |
| RU | 2137659 | 9/1999 |

* cited by examiner

15

16

SELF-BALANCING PRESSURE HULL DEVICE

CROSS-REFERENCE TO RELATED APPLICATION

This application is a 371 of international application of PCT application serial no. PCT/CN2016/094256, filed on Aug. 9, 2016, which claims the priority benefit of China application no. 201510586853.2, filed on Sep. 15, 2015. The entirety of each of the above-mentioned patent applications is hereby incorporated by reference herein and made a part of this specification.

BACKGROUND

Technical Field

In the technical field of submersibles, the present invention relates to a pressure structure of a deep-sea submersible, and in particular, to a self-balancing pressure hull device of three layers in a pressure decline mode.

Description of Related Art

As the speed of ocean development continues to accelerate, the depth of exploration from offshore to distant sea constantly increases. Submersibles with various functions are of a great variety and develop rapidly, which are mainly applied in marine resource exploration and development, scientific research, military exploration, salvage, and other aspects. A submersible is important equipment for ocean exploration and deep-sea scientific research. As a crucial part of the submersible, a pressure hull is used to guarantee normal operation of internal apparatuses and health and safety of the crew in a diving process. The weight thereof accounts for ¼ to ½ of the total weight of the submersible. The design of the pressure hull has an important influence on performance such as safety of the submersible, a carrying capacity, a man-machine environment, and the like. The submersible withstands a high pressure and low temperature in the deep sea, and the flow of the sea water further causes the submersible to vibrate. However, various instruments and apparatuses carried in the submersible generally need to operate under normal pressure and temperature, and survival conditions of submerged members further need to approach those on land. Therefore, there is a high requirement on a pressure structure of the submersible.

The deep-sea submersible mainly has the following problems:

(1) The deep-sea submersible greatly vibrates under complicated underwater conditions, thus greatly affecting stable operations of various instruments and apparatuses, and the working environment of researchers. An existing submersible mainly uses a relatively complicated negative feedback closed-loop control system to control multiple groups of propellers disposed around the submersible, to adjust the posture of the submersible and reduce the vibration. However, such a control manner needs to consume a lot of energy, and the whole control system has a complicated structure and low reliability. For a single-layer pressure hull, even after a counterweight is added to the bottom, it is still difficult to eliminate or reduce the vibration of the pressure hull caused by the flow of the external sea water.

(2) For the deep-sea submersible, the pressure hull withstands a high external water pressure. If a conventional single-layer pressure hull is used, a high-strength material needs to be used or the thickness of the hull needs to be increased. The range of optional materials is small and the processing difficulty is great.

(3) The deep-sea submersible produces big noise during operation, which severely affects underwater work of the researchers and normal operation of communication devices. Thus, the hull needs to have a desirable soundproof property. The water temperature is low in the deep sea, and therefore the hull further needs to have a desirable thermal insulation and heat preservation function. The existing submersibles mostly use a composite material or plate and shell structure to weaken the noise. However, such a soundproof manner weakens the noise only in a certain range, and it is difficult to eliminate the noise or reduce it to a low value. In order to maintain the constant temperature inside the compartment in a low-temperature environment, a high-power temperature control device and a thermal insulation material are usually used to maintain the constant temperature inside the compartment of the submersible. However, such a temperature control manner has a high requirement on performance of a temperature control apparatus, and the temperature control apparatus needs to consume a lot of energy.

SUMMARY

To solve the foregoing problems, the present invention provides a novel self-balancing pressure hull device in a pressure decline mode.

To achieve the foregoing objective, the technical solution of the present invention is as follows:

A self-balancing pressure hull device is assembled by successively nesting, from inside to outside, a spherical inner housing, a spherical intermediate housing and a spherical outer housing around the sphere center, two pairs of symmetric coaxial connecting shaft assemblies being connected between the spherical inner housing and the spherical intermediate housing and between the spherical intermediate housing and the spherical outer housing, respectively; axes of the two pairs of connecting shaft assemblies being perpendicular to each other so as to enable the spherical inner housing and the spherical intermediate housing to rotate relative to each other, and the spherical intermediate housing and the spherical outer housing to rotate relative to each other; and each of the connecting shaft assemblies in the two pairs of connecting shaft assemblies being provided with a spring damper for resisting an axial impact between each two adjacent housings.

The spherical inner housing is formed by connecting a hemispherical inner housing I and a hemispherical inner housing II, the spherical intermediate housing is formed by connecting a hemispherical intermediate housing I and a hemispherical intermediate housing II, and the spherical outer housing is formed by connecting a hemispherical outer housing I and a hemispherical outer housing II.

The two connecting shaft assemblies of the pair of the connecting shaft assemblies between the spherical intermediate housing and the spherical outer housing are of the same structure and size, and each connecting shaft assembly of the pair of the connecting shaft assemblies between the spherical intermediate housing and the spherical outer housing includes a spring damper, a slide bearing pedestal, a connecting shaft, a slide bearing, an inner bearing bush, an outer bearing bush, a bearing press plate, and a screw, the slide bearing being fixed on the connecting shaft via the bearing press plate and the screw; the inner bearing bush being disposed between an inner wall of the slide bearing and the connecting shaft; the connecting shaft being supported on an outer wall of the spherical intermediate housing; the slide bearing pedestal being supported on an inner wall of the spherical outer housing; the outer bearing bush being disposed between an outer wall of the slide bearing and the slide bearing pedestal; and the spring damper being mounted on an outer side of the slide bearing pedestal, with two ends being tightly pressed against the connecting shaft and a protrusion of the slide bearing pedestal respectively. The two connecting shaft assemblies of the pair of the connecting shaft assemblies between the spherical inner housing and the spherical intermediate housing are of the same structure and size, and each connecting shaft assembly of the pair of the connecting shaft assemblies between the spherical inner housing and the spherical intermediate housing includes a spring damper, a slide bearing pedestal, a connecting shaft, a slide bearing, an inner bearing bush, an outer bearing bush, a bearing press plate, and a screw, the slide bearing being fixed on the connecting shaft via the bearing press plate and the screw; the inner bearing bush being disposed between an inner wall of the slide bearing and the connecting shaft; the connecting shaft being supported on an outer wall of the spherical inner housing; the slide bearing pedestal being supported on an inner wall of the spherical intermediate housing; the outer bearing bush being disposed between an outer wall of the slide bearing and the slide bearing pedestal; and the spring damper being mounted on an outer side of the slide bearing pedestal, with two ends being tightly pressed against the connecting shaft and a protrusion of the slide bearing pedestal respectively.

The spherical inner housing is provided with an inner compartment hatch, the spherical intermediate housing is provided with an intermediate compartment hatch, and the spherical outer housing is provided with an outer compartment hatch, the inner compartment hatch, the intermediate compartment hatch, and the outer compartment hatch being each disposed with a circular hatch cover; an inner hatch cover is connected to the inner wall of the inner housing via an inner hatch cover connecting pin-shaft assembly, tightly pressed by an inner hatch cover press plate mounted on the inner wall of the inner housing, and sealed by an O-shaped seal ring; an intermediate hatch cover is connected to the outer wall of the inner housing via an intermediate hatch cover connecting pin-shaft assembly, tightly pressed by an intermediate hatch cover press plate mounted on the outer wall of the intermediate housing, and sealed by an O-shaped seal ring; and an outer hatch cover is connected to the outer wall of the outer housing via an outer hatch cover connecting pin-shaft assembly, tightly pressed by an outer hatch cover press plate mounted on the outer wall of the outer housing, and sealed by an O-shaped seal ring. The inner hatch cover press plate is connected to the inner housing via a mandrel assembly and tightly pressed by a screw assembly; the intermediate hatch cover press plate is connected to the intermediate housing via a mandrel assembly and tightly pressed by a screw assembly; and the outer hatch cover press plate is connected to the outer housing via a mandrel assembly and tightly pressed by a screw assembly.

Diameters $D_1$, $D_2$, and $D_3$ of the spherical inner housing, the spherical intermediate housing and the spherical outer housing meet the following proportional relationship: 2:3:4, the diameter of the spherical inner housing ranging from 2.2 m to 3.1 m. Diameters $L_1$, $L_2$, and $L_3$ of the inner compartment hatch, the intermediate compartment hatch and the outer compartment hatch meet the following proportional relationship: 1:1:2, the diameter of the inner compartment hatch ranging from 0.7 m to 1.1 m.

An inner hatch cover hose connector is connected to an outer hatch cover hose connector via an inner compartment hose and connector assembly to connect an inner compartment inside the spherical inner housing with an external auxiliary submersible, so as to maintain a standard air pressure in the inner compartment inside the spherical inner housing; an intermediate hatch cover hose connector is connected to the outer hatch cover hose connector via an intermediate compartment hose and connector assembly to connect an intermediate compartment between the spherical inner housing and the spherical intermediate housing with the external auxiliary submersible, so as to maintain a vacuum in the intermediate compartment between the spherical inner housing and the spherical intermediate housing; and an outer compartment between the intermediate housing and the outer housing is connected to the external auxiliary submersible via the outer hatch cover hose connector, so as to maintain an air pressure in the outer compartment between the intermediate housing and the outer housing at a half of a hydraulic pressure outside the submersible at its working depth, the outer hatch cover hose connector being a three-tier metal connector in a nesting mode, with inner, middle, and outer tiers being respectively connected to the inner, intermediate, and outer compartments via metal hoses; and the inner hatch cover hose connector, the intermediate hatch cover hose connector and the outer hatch cover hose connector being respectively connected to the inner hatch cover, the intermediate hatch cover and the outer hatch cover through threads and sealed by O-shaped seal rings.

Pairs of symmetric limiting buffers are provided between the spherical inner housing and the spherical intermediate housing and between the spherical intermediate housing and the spherical outer housing, respectively; a connecting line of the limiting buffers between the spherical inner housing and the spherical intermediate housing is perpendicular to an axis of connecting shaft assemblies between the spherical inner housing and the spherical intermediate housing; and a connecting line of the limiting buffers between the spherical intermediate housing and the spherical outer housing is perpendicular to a connecting axis of the intermediate inner housing and the spherical outer housing. The two limiting buffers between the spherical inner housing and the spherical intermediate housing are of the same structure and size, and each limiting buffer includes an upper support plate, a middle support plate, a lower support plate, an upper hydraulic damper, and a lower hydraulic damper, the middle support plate being welded to the outer wall of the spherical inner housing; the upper support plate and the lower support plate being respectively disposed on an upper support plate pedestal and a lower support plate lower pedestal which are connected to the inner wall of the spherical intermediate housing; the upper hydraulic damper and the lower hydraulic damper being symmetrically arranged about the middle support plate; one end of each of the upper hydraulic damper and the lower hydraulic damper being connected to the middle support plate via a universal joint; the other end of the upper hydraulic damper being connected to the upper support plate via a universal joint; and the other end of the lower hydraulic damper being connected to the lower support plate via a universal joint. The two limiting buffers between the spherical intermediate housing and the spherical outer housing are of the same structure and size, and each limiting buffer includes an upper support plate, a middle support plate, a lower support plate, an upper hydraulic damper, and a lower hydraulic damper, the middle support plate being welded to the outer wall of the spherical inner housing; the upper support plate and the lower support plate being respectively disposed on an upper support plate pedestal and a lower support plate pedestal which are connected to the inner wall of the spherical intermediate housing; the upper hydraulic damper and the lower hydraulic damper being symmetrically arranged about the middle support plate; one end of each of the upper hydraulic damper and the lower hydraulic damper being connected to the middle support plate via a universal joint; the other end of the upper hydraulic damper being connected to the upper support plate via a universal joint; and the other end of the lower hydraulic damper being connected to the lower support plate via a universal joint.

The upper support upper pedestal and the lower support plate pedestal are two symmetric semi-pedestals, the two semi-pedestals being welded to rims of corresponding hemispherical housings respectively; and after the two hemispherical housings are assembled into a complete spherical housing, the upper support plate and the lower support plate are clamped in the two corresponding semi-pedestals respectively.

A counterweight is placed on each of the bottoms of the spherical inner housing, the spherical intermediate housing and the spherical outer housing.

The inner, intermediate, and outer housings of the present invention are equivalent to an inner frame, a gimbal, and an outer frame of a two-axis gyroscope, respectively. A connecting shaft between each adjacent housings possesses two degrees of freedom: rotation and axial movement. Assuming that the inner housing is immovable, the outer housing possesses four degrees of freedom. Because the inner housing, and the crew and objects in the compartment have large inertia, the vibration and movement of the outer housing with respect to the water surface are almost eliminated after reaching the inner compartment through balancing by two groups of spring dampers and hydraulic dampers, ensuring stability of the inner compartment.

The three compartment doors are closed before diving of the submersible. The three-tier nesting-mode outer hatch cover hose connector is connected to a pressure machine, to maintain a standard air pressure inside the inner compartment by using an inner compartment metal hose assembly. The intermediate compartment is sucked to vacuum through an intermediate compartment metal hose assembly via a middle annular hole of the three-tier nesting-mode outer hatch cover hose connector. The existence of the vacuum intermediate compartment reduces heat dissipation from the inner compartment and further insulates the inner compartment from the outside noise. The outer compartment is filled with high-pressure inert light gas, helium, through an outer annular hole of the three-tier nesting-mode outer hatch cover hose connector 121, with a gas pressure being of a half of an external hydraulic pressure at corresponding working depth, thus greatly enhancing the operation security of the submersible and broadening the range of optional materials during manufacturing of the pressure hull of the submersible. Due to occurrence of leakage, in order to maintain the standard air pressure in the inner compartment, vacuum in the intermediate compartment, and the high pressure in the outer compartment, the three-tier nesting-mode outer hatch cover hose connector 121 needs to be connected to an auxiliary submersible, to maintain corresponding air pressures in the three compartments.

The present invention has the following beneficial effects:

(1) With reference to a structural principle of a two-axis gyroscope, the self-balancing pressure hull device of the present invention has a three-layer structure. The outermost housing is equivalent to an outer frame of the gyroscope, the intermediate housing is equivalent to a gimbal of the gyroscope, and the inner housing is equivalent to the inner frame of the gyroscope. The three housings are mutually connected by using two groups of rotary shafts, and an axis of the rotary shafts between the inner layer and the intermediate layer is perpendicular to that of the rotary shafts between the intermediate layer and the outer layer. By use of such a three-layer rotary hull structure in the mode of a two-axis gyroscope, the horizontal and vertical vibrations of the outer housing have been greatly reduced after being transferred to the inner housing, thus maintaining the inner housing relatively balanced and stable.

Ends of the shafts in the two groups are each mounted with a spring, which can reduce an axial impact between each two adjacent housings and resist relative rotation. Because a spring damper is added on each of connecting shafts between adjacent housings, the vibration of the outer housing along the horizontal direction has been greatly reduced after being transferred to the inner housing under the effect of the intermediate housing and the springs.

A self-balancing mechanical device is used, which is in a passive control manner. Therefore, a control system is simplified, the operation reliability and running stability of the submersible are improved, and the comfort of the working environment of submerged members is improved.

(2) The outer compartment between the intermediate housing and the outer housing is filled with high-pressure light gas. Therefore, the pressure is gradually reduced from the outside of the pressure hull of the submersible, to the outer compartment between the outer and the intermediate housings, and to the intermediate compartment between the intermediate and the inner housings. Compared with a single-layer hull with only the outer layer withstanding the high pressure, the present invention is greatly improved in stability, thus improving the operation security of the submersible, broadening the range of optional materials, reducing the thickness of the housings, and reducing the difficulty of processing the housings.

(3) The intermediate compartment between the intermediate housing and the inner housing is vacuum, thus preventing heat dissipation and sound transmission, maintaining relatively stable temperature inside the inner compartment, and insulating the inner compartment from big noise of an external propulsion system, so that the working environment inside the compartment is greatly improved.

Figure 1:
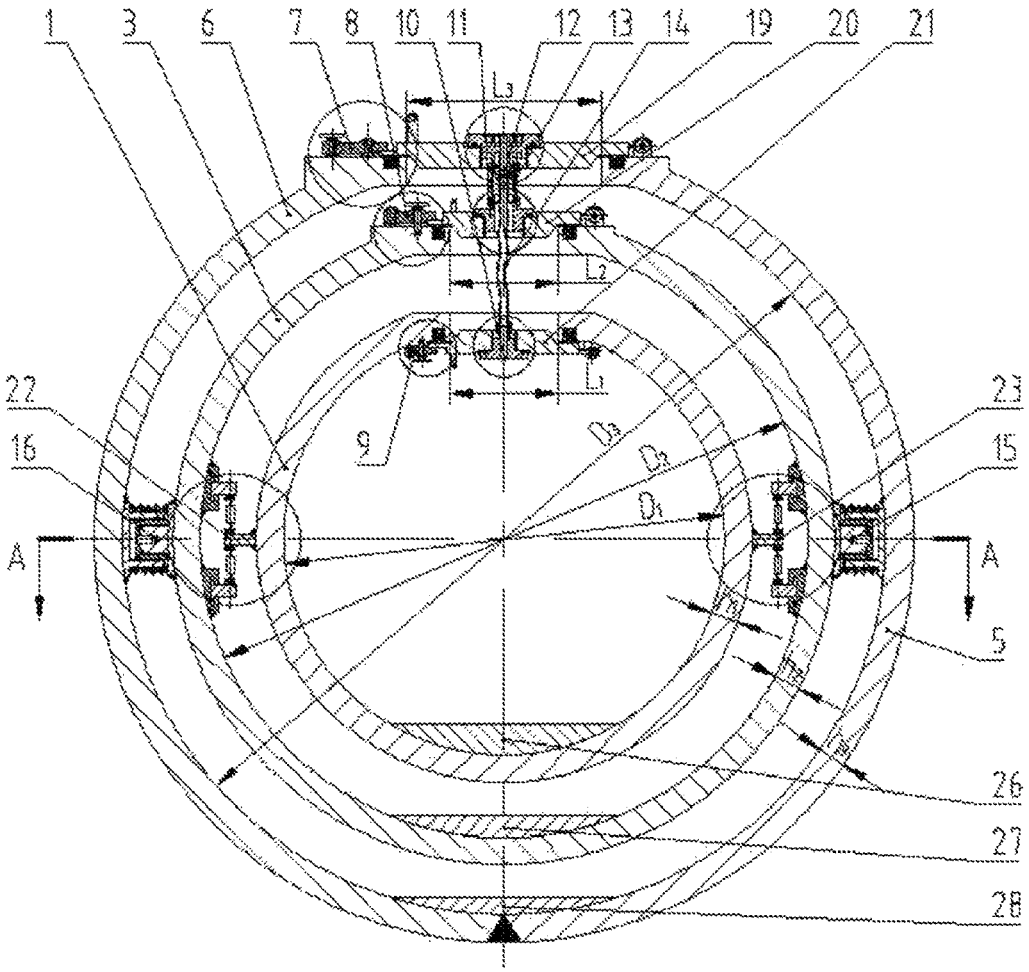
FIG. 1 is a front view of a complete section of a completely assembled self-balancing pressure hull device.
Figure 2:
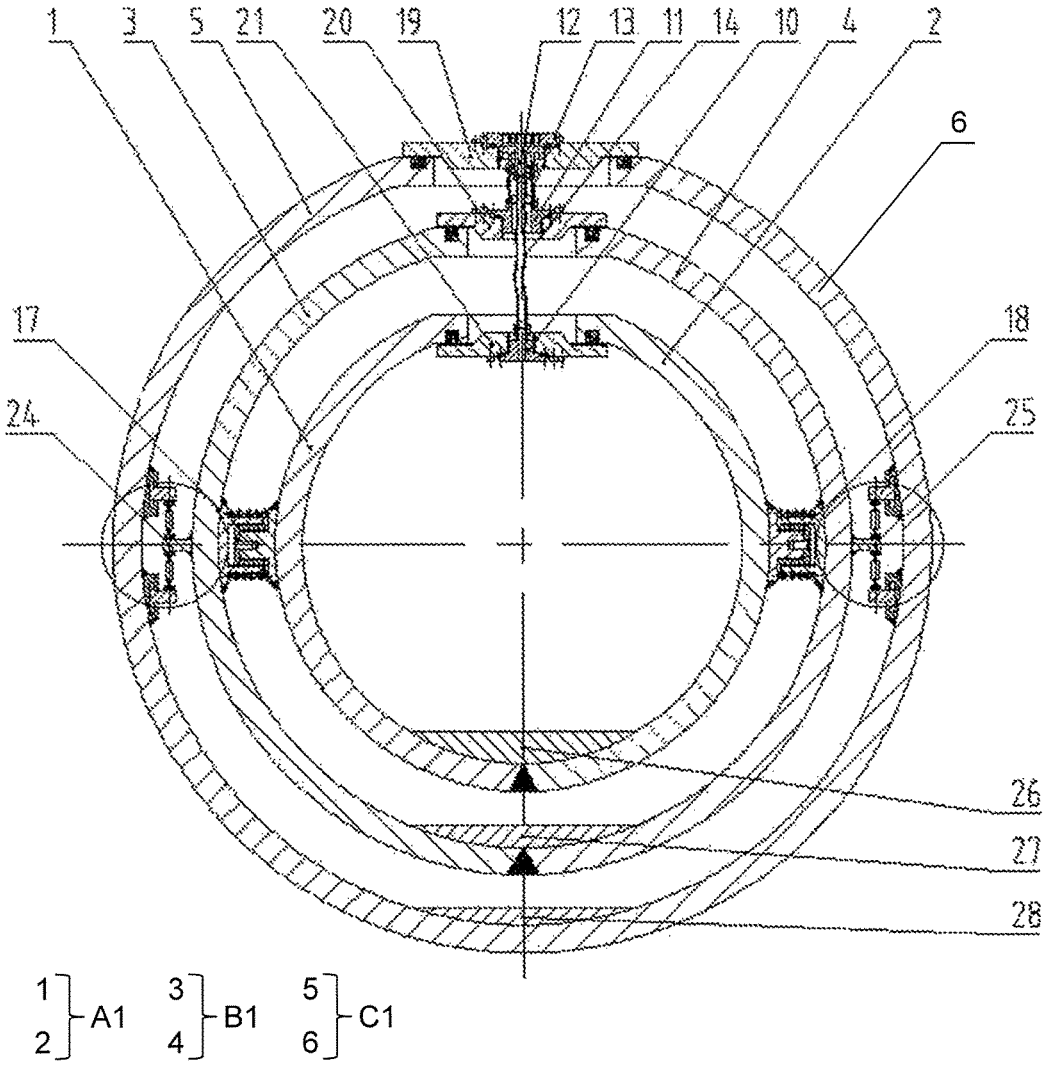
FIG. 2 is a left view of a complete section of a completely assembled self-balancing pressure hull device.
Figure 3:
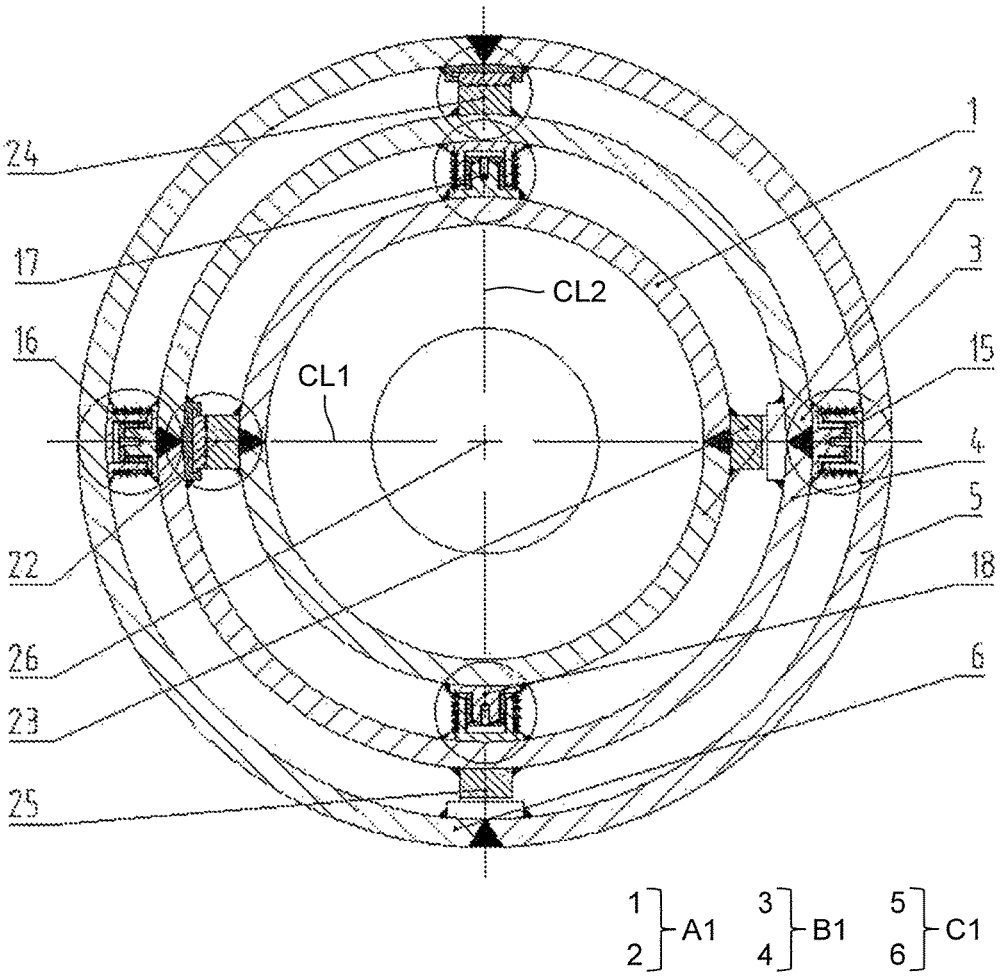
FIG. 3 is a top view of a complete section of a completely assembled self-balancing pressure hull device.

In the drawings: A1—spherical inner housing, B1—spherical intermediate housing, C1—spherical outer housing C1, S1—center, 1—hemispherical inner housing, 2—hemispherical inner housing, 3—hemispherical intermediate housing, 4—hemispherical intermediate housing, 5—hemispherical outer housing, 6—hemispherical outer housing, 7—outer hatch cover press plate assembly, 71—outer hatch cover screw, 72—outer hatch cover press plate, 73—outer hatch cover mandrel assembly, 8—intermediate hatch cover press plate assembly, 81—intermediate hatch cover mandrel assembly, 82—intermediate hatch cover press plate, 83—intermediate hatch cover screw, 9—inner hatch cover press plate assembly, 91—inner hatch cover mandrel assembly, 92—inner hatch cover screw, 93—inner hatch cover press plate, 10—inner hatch cover hose connector assembly, 101—inner hatch cover hose connector, 102—inner hatch cover hose connector seal ring, 11—intermediate hatch cover hose connector assembly, 111—intermediate hatch cover hose connector, 112—intermediate hatch cover hose connector seal ring, 12—outer hatch cover hose connector assembly, 121—outer hatch cover hose connector, 122—outer hatch cover hose connector seal ring, 13—intermediate compartment hose and connector assembly, 131—intermediate compartment hose nut, 132—intermediate compartment hose seal ring, 133—intermediate compartment hose sealing bush, 134—intermediate compartment hose, 135—intermediate compartment hose sealing bush, 136—intermediate compartment hose seal ring, 137—intermediate compartment hose nut, 14—inner compartment hose and connector assembly, 141—inner compartment hose nut, 142—inner compartment hose seal ring, 143—inner compartment hose sealing bush, 144—inner compartment hose, 145—inner compartment hose sealing bush, 146—inner compartment hose seal ring, 147—inner compartment hose nut, 15—connecting shaft assembly, 151—spring damper, 152—slide bearing pedestal, 153—connecting shaft, 154—bearing press plate, 155—screw, 156—inner bearing bush, 157—slide bearing, 158—outer bearing bush, 16—connecting shaft assembly, 161—spring damper, 162—slide bearing pedestal, 163—connecting shaft, 164—bearing press plate, 165—screw, 166—inner bearing bush, 167—slide bearing, 168—outer bearing bush, 17—connecting shaft assembly, 171—spring damper, 172—slide bearing pedestal, 173—connecting shaft, 174—bearing press plate, 175—screw, 176—inner bearing bush, 177—slide bearing, 178—outer bearing bush, 18—connecting shaft assembly, 181—spring damper, 182—slide bearing pedestal, 183—connecting shaft, 184—bearing press plate, 185—screw, 186—inner bearing bush, 187—slide bearing, 188—outer bearing bush, 19—outer hatch cover assembly, 191—outer hatch cover seal ring, 192—outer hatch cover, 193—outer hatch cover connecting pin-shaft, 20—intermediate hatch cover assembly, 201—intermediate hatch cover seal ring, 202—intermediate hatch cover, 203—intermediate hatch cover connecting pin-shaft, 21—inner hatch cover assembly, 211—inner hatch cover seal ring, 212—inner hatch cover, 213—inner hatch cover connecting pin-shaft, 22—rotary limiting buffer, 221—upper support plate, 222—universal joint, 223—upper hydraulic damper, 224—universal joint, 225—middle support plate, 226—universal joint, 227—lower hydraulic damper, 228—universal joint, 229—lower support plate, 2210—upper support plate pedestal, 2211—lower support plate lower pedestal, 23—rotary limiting buffer, 231—upper support plate, 232—universal joint, 233—upper hydraulic damper, 234—universal joint, 235—middle support plate, 236—universal joint, 237—lower hydraulic damper, 238—universal joint, 239—lower support plate, 24—rotary limiting buffer, 241—upper support plate, 242—universal joint, 243—upper hydraulic damper, 244—universal joint, 245—middle support plate, 246—universal joint, 247—lower hydraulic damper, 248—universal joint, 249—lower support plate, 2410—upper support plate pedestal, 2411—lower support plate pedestal, 25—rotary limiting buffer, 251—upper support plate, 252—universal joint, 253—upper hydraulic damper, 254—universal joint, 255—middle support plate, 256—universal joint, 257—lower hydraulic damper, 258—universal joint, 259—lower support plate, 26—counterweight on the inner housing, 27—counterweight on the intermediate housing, and 28—counterweight on the outer housing.

DESCRIPTION OF THE EMBODIMENTS

The working principle, connection, and assembly of a self-balancing pressure hull device of the present invention is described in detail below with reference to FIG. 1 to FIG. 15 of the disclosure.

As shown in FIG. 2 to FIG. 9, the present disclosure is assembled by successively nesting, from inside to outside, a spherical inner housing A1, a spherical intermediate housing B1 and a spherical outer housing C1 around the sphere center S1. The spherical inner housing A1 and the spherical intermediate housing B1, as well as the spherical intermediate housing B1 and the spherical outer housing C1, are axially connected via a pair of slide bearings 157/167/177/187. Two axes are mutually perpendicular, such that the spherical inner housing A1 and the spherical intermediate housing B1, as well as the spherical intermediate housing B1 and the spherical outer housing C1, can rotate relative to each other. Each of the connecting shafts in the two pairs is provided with a spring damper 151/161/171/181 at the outside, for resisting an axial impact between each two adjacent housings. The spherical inner housing A1 is formed by connecting a hemispherical inner housing 1 and a hemispherical inner housing 2, the spherical intermediate housing B1 is formed by connecting a hemispherical intermediate housing 3 and a hemispherical intermediate housing 4, and the spherical outer housing C1 is formed by connecting a hemispherical outer housing 5 and a hemispherical outer housing 6.

Figure 10:
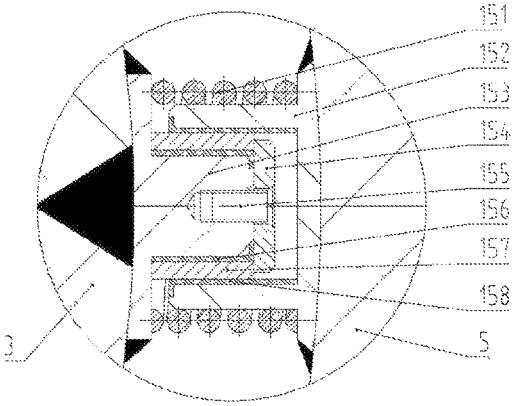
FIG. 10 is a partial enlarged sectional view of a connecting shaft assembly 15 between an inner housing and an intermediate housing.
Figure 11:
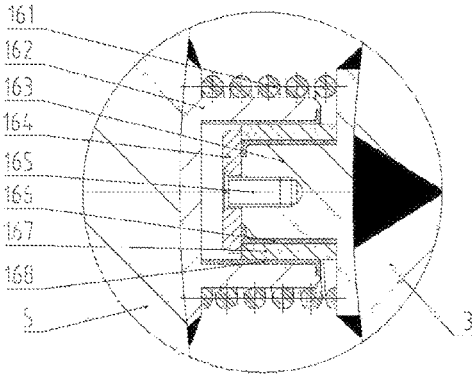
FIG. 11 is a partial enlarged sectional view of a connecting shaft assembly 16 between an inner housing and an intermediate housing.

FIG. 10 and FIG. 11 show a pair of connecting shaft assemblies 15 and 16 connecting the hemispherical intermediate housing 3 and the hemispherical outer housing 5. Because their structures and sizes are totally identical, they are described by using FIG. 10 as an example. The connecting shaft assembly 15 between the hemispherical intermediate housing 3 and the hemispherical outer housing 5 includes a spring damper 151, a slide bearing pedestal 152, a connecting shaft 153, a slide bearing 157, inner bearing bush 156, outer bearing bush 158, a bearing press plate 154, and a screw 155. The slide bearing 157 uses an integral self-lubricating bearing, and lubricating grease is smeared in the connecting shaft assembly 15.

Figure 12:
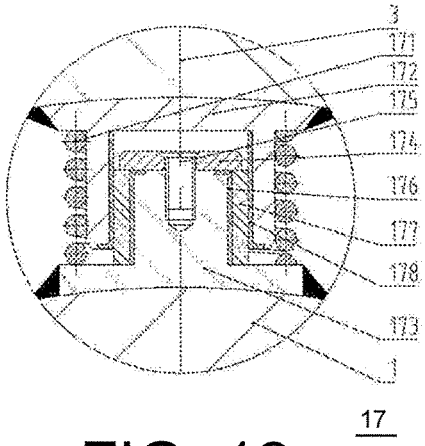
FIG. 12 is a partial enlarged sectional view of a connecting shaft assembly 17 between an intermediate housing and an outer housing.
Figure 13:
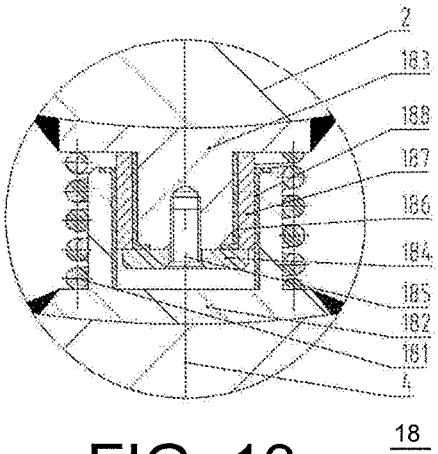
FIG. 13 is a partial enlarged sectional view of a connecting shaft assembly 18 between an intermediate housing and an outer housing.

The slide bearing 157 is fixed on a connecting shaft 153 via a bearing press plate 154 and a screw 155, and is supported by an slide bearing pedestal 152. The spring damper 151 is mounted on an outer side of the slide bearing pedestal 152, with two ends being tightly pressed against a protrusion. FIG. 12 and FIG. 13 show a pair of connecting shaft assemblies 17 and 18 connecting the hemispherical inner housing 1 and the hemispherical intermediate housing 3. Because their structures and sizes are totally identical, they are introduced by using FIG. 12 as an example. The connecting shaft assembly 17 between the hemispherical inner housing 1 and the hemispherical intermediate housing 3 includes a spring damper 171, a slide bearing pedestal 172, a connecting shaft 173, a slide bearing 177, inner bearing bush 176, outer bearing bush 178, a bearing press plate 174, and a screw 175. The slide bearing 177 is fixed on a connecting shaft 173 via a bearing press plate 174 and a screw 175, and is supported by a slide bearing pedestal 172. The spring damper 171 is mounted on an outer side of the slide bearing pedestal 172, with two ends being tightly pressed against a protrusion. The connecting shafts 153, 163, 173, and 183 and the slide bearing pedestals 152, 162, 172, and 182 are welded to corresponding housings.

In order to ensure that the three compartment doors of the spherical inner housing A1, the spherical intermediate housing B1 and the spherical outer housing C1 face upwards in the same directions under the balanced state of the spherical housings A1, B1, and C1, and to maintain a correct posture of the whole submersible, the following two measures are adopted: First, counterweights 26, 27, and 28 are placed on each of the bottoms of the housings A1, B1, and C1 (as shown in FIG. 1), and the center of gravity is lowered. Secondly, two ends of each spring damper 151/161/171/181 is connected to a corresponding housing or a rubber damper is used instead.

Figure 17:
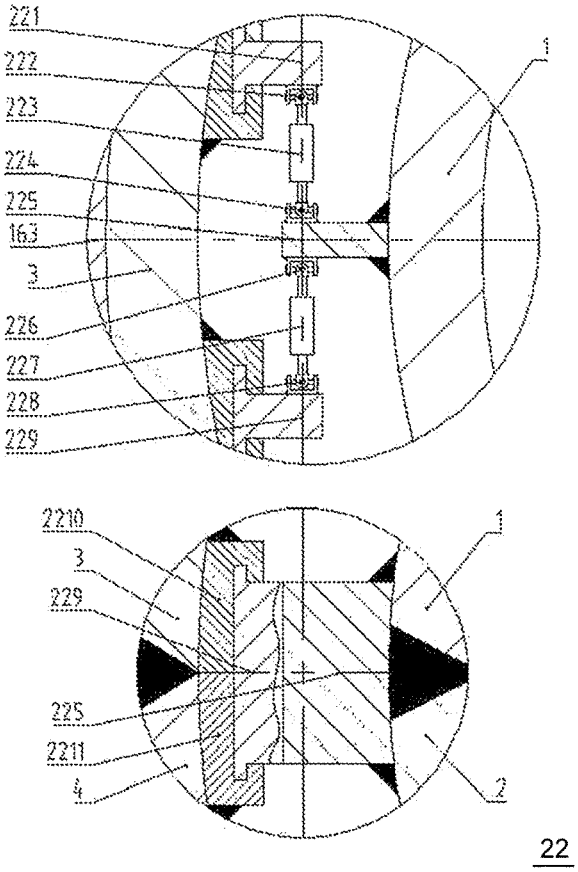
FIG. 17 is a partial enlarged sectional view of a rotary buffering and limiting assembly 22 between an inner housing and an intermediate housing.
Figure 18:
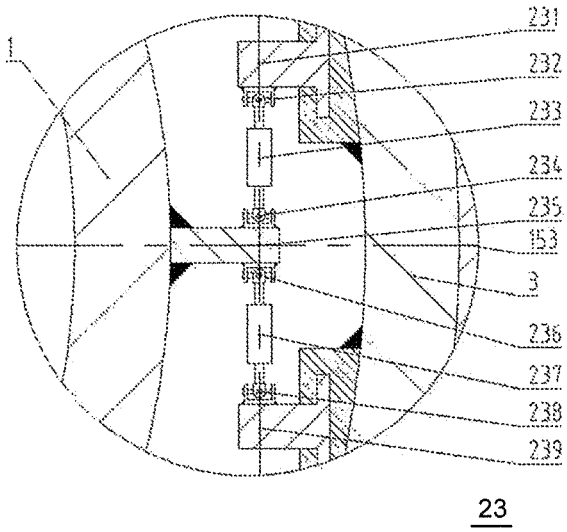
FIG. 18 is a partial enlarged sectional view of a rotary buffering and limiting assembly 23 between an inner housing and an intermediate housing.
Figure 19:
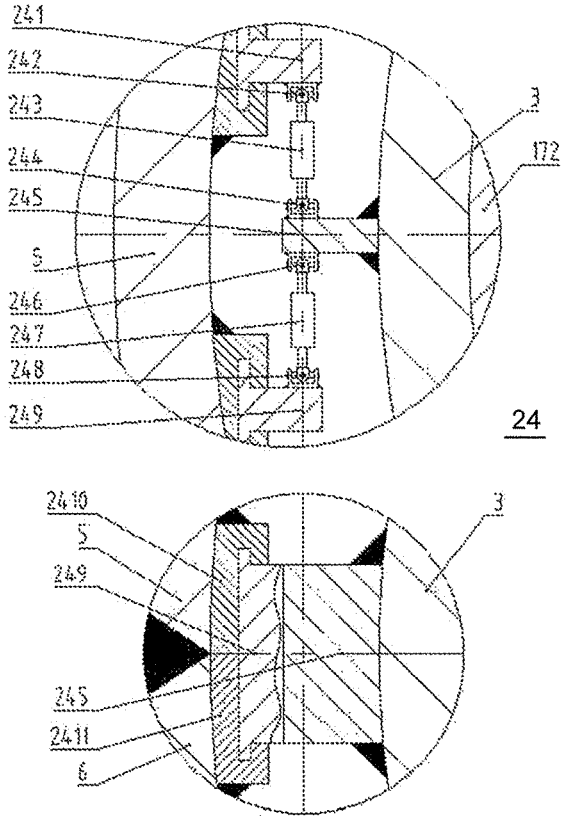
FIG. 19 is a partial enlarged sectional view of a rotary buffering and limiting assembly 24 between an intermediate housing and an outer housing.
Figure 20:
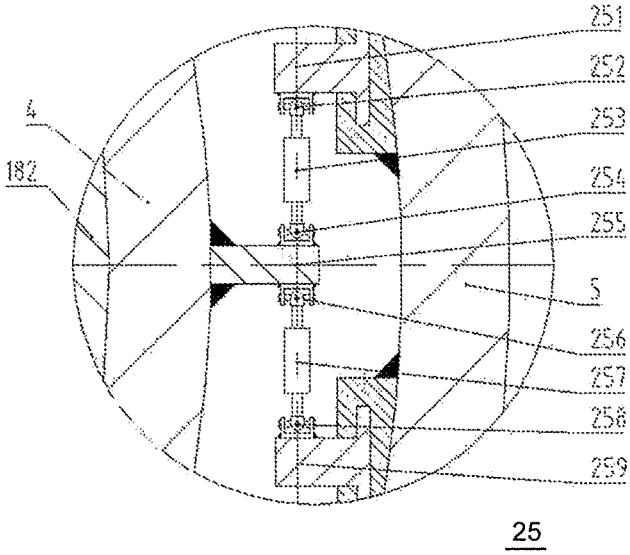
FIG. 20 is a partial enlarged sectional view of a rotary buffering and limiting assembly 25 between an intermediate housing and an outer housing.

During actual operation of the submersible, in order to prevent connecting pipelines and other accessories from being damaged due to relative rotation between the three housings A1, B1, and C1, it is required to limit relative rotation between each adjacent housings, and it is stipulated that an absolute value of a rotation angle between the adjacent housings is not greater than 15°. Moreover, it is required to buffer relative rotation between each adjacent housings. FIG. 17 and FIG. 18 respectively show rotary limiting buffers 22 and 23 between the hemispherical inner housing 1 and the hemispherical intermediate housing 3, and FIG. 19 and FIG. 20 respectively show a rotary limiting buffer 24 between the hemispherical intermediate housing 3 and the hemispherical outer housing 5 and a rotary limiting buffer 25 between the hemispherical intermediate housing 4 and the hemispherical outer housing 5. Because the rotary limiting buffers 22, 23, 24, and 25 are of the identical structures, they are described by using FIG. 17 as an example. The whole rotary limiting buffer 22 includes upper support plate 221, middle support plate 225, and lower support plate 229 and corresponding upper support plate pedestal 2210 and lower support plate pedestal 2211, two symmetrically disposed upper hydraulic damper 223 and lower hydraulic damper 227, and four universal joints 222, 224, 226, and 228 for connecting the hydraulic dampers 223 and 227 and the support plates 221, 225, and 229. A connecting line CL1 of the rotary limiting buffers 22 and 23 between the spherical inner housing A1 and the spherical intermediate housing B1 is perpendicular to a connecting line CL2 of the connecting shaft assemblies 17 and 18 between the spherical inner housing A1 and the spherical intermediate housing B1, and a connecting line CL2 of the rotary limiting buffers 24 and 25 between the spherical intermediate housing B1 and the spherical outer housing C1 is perpendicular to a connecting line CL1 of the connecting shaft assemblies 15 and 16 between the spherical intermediate housing B1 and the spherical outer housing C1. When the submersible is at a stable and balanced state, the two pairs of housing connecting shaft assemblies 15, 16, 17, and 18 and rotary limiting buffers 22, 23, 24, and 25 are on the same horizontal plane. The middle support plates 225, 235, 245, and 255 are welded to the housings A1, B1, and C1, and the universal joints 222, 224, 226, 228, 232, 234, 236, 238, 242, 244, 246, 248, 252, 254, 256, and 258 are welded to corresponding support plates 221, 225, 229, 231, 235, 239, 241, 245, 249, 251, 255, and 259. The upper support plate pedestal 2210 (or 2410) and the lower support plate pedestal 2211 (or 2411) of the hydraulic dampers 223, and 227 (or 243, and 247) are two symmetric semi-pedestals. The two semi-pedestals are welded to rims of corresponding hemispherical housings 1, 2, 3, 4, 5, and 6 respectively. After the two hemispherical housings are assembled into a complete spherical housing, each upper support plate 221 (or 241) and the lower support plate 229 (or 249) of the hydraulic dampers 223, and 227 (or 243, and 247) are clamped in the two corresponding semi-pedestals respectively.

To ensure sufficient space between each adjacent housings, it is stipulated that diameters $D_1$, $D_2$, and $D_3$ of the spherical inner housing A1, the spherical intermediate housing B1, and the spherical outer housing C1 meet the following proportional relationship: 2:3:4, the diameter of the spherical inner housing A1 ranging from 2.2 m to 3.1 m. Withstanding a high pressure, the spherical intermediate housing B1 and the spherical outer housing C1 need to use a high-strength alloy material. The titanium alloy is recommended, where a thickness $h_2$ of the spherical intermediate housing and a thickness $h_3$ of the spherical outer housing are calculated according to the design depth of the submersible. Withstanding a low pressure, the spherical inner housing A1 may use common low-carbon alloy steel, where a thickness hi of the spherical inner housing is calculated according to the permissible stress of the material and a withstood air pressure.

Figure 14:
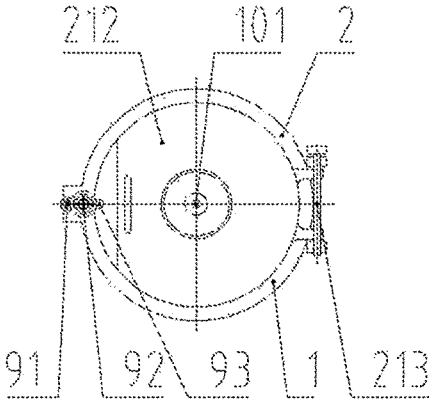
FIG. 14 is a partial bottom view of an inner hatch cover assembly 21 and an inner hatch cover press plate assembly 9.
Figure 15:
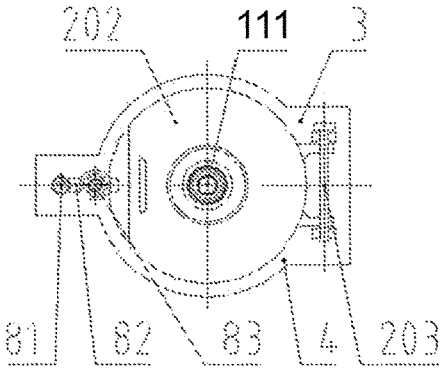
FIG. 15 is a partial top view of an intermediate hatch cover assembly 20 and an intermediate hatch cover press plate assembly 8.
Figure 16:
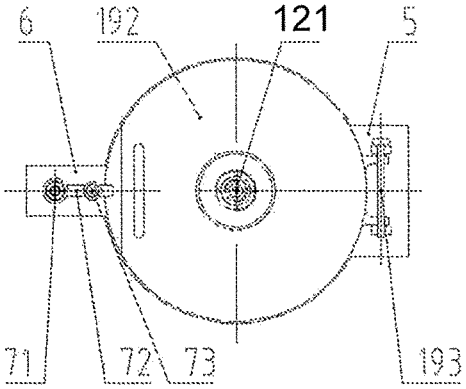
FIG. 16 is a partial top view of an outer hatch cover assembly 19 and an outer hatch cover press plate assembly 7.

As shown in FIG. 1, an inner hatch cover assembly 21, an intermediate hatch cover assembly 20, and an outer hatch cover assembly 19 are successively disposed from the bottom up. The three hatch cover assemblies 19, 20, and 21 are each provided with a circular hatch covers (as shown in FIG. 16, FIG. 14, and FIG. 15). An inner hatch cover 212 is connected to inner walls of the hemispherical inner housings 1 and 2 via an inner hatch cover connecting pin-shaft assembly 213, tightly pressed by an inner hatch cover press plate 93 mounted on the inner walls of the hemispherical inner housings 1 and 2, and sealed by an O-shaped inner hatch cover seal ring 211 shown in FIG. 6. An intermediate hatch cover 202 is connected to outer walls of the hemispherical intermediate housings 3 and 4 via an intermediate hatch cover connecting pin-shaft assembly 203, tightly pressed by an intermediate hatch cover press plate 82 mounted on outer walls of the hemispherical intermediate housings 3 and 4, and sealed by an O-shaped intermediate hatch cover seal ring 201 shown in FIG. 5. An outer hatch cover 192 is connected to outer walls of the hemispherical outer housings 5 and 6 via an outer hatch cover connecting pin-shaft assembly 193, tightly pressed by an outer hatch cover press plate 72 mounted on the outer walls of the hemispherical outer housings 5 and 6, and sealed by an O-shaped outer hatch cover seal ring 191 shown in FIG. 4.

Figure 4:
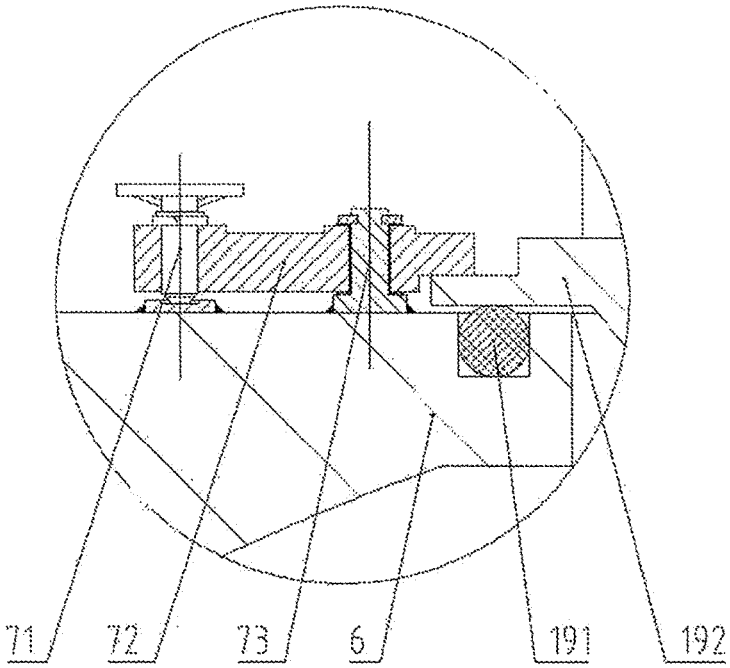
FIG. 4 is a partial enlarged sectional view of an outer hatch cover press plate assembly 7 and an outer hatch cover sealing member.
Figure 5:
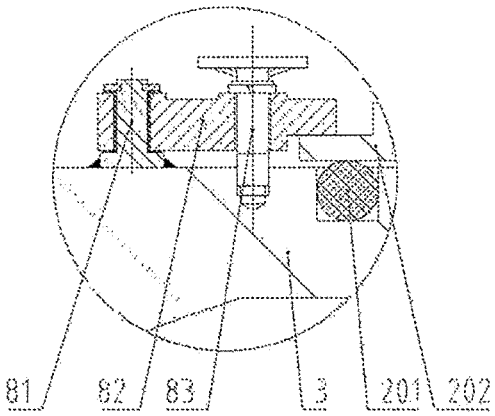
FIG. 5 is a partial enlarged sectional view of an intermediate hatch cover press plate assembly 8 and an intermediate hatch cover sealing member.
Figure 6:
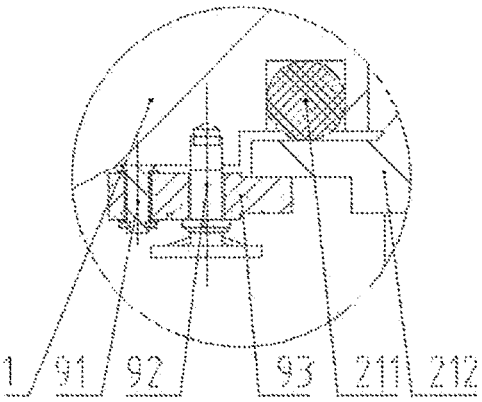
FIG. 6 is a partial enlarged sectional view of an inner hatch cover press plate assembly 9 and an inner hatch cover sealing member.

The inner hatch cover press plate 93 is connected to the hemispherical inner housing 1 via an inner hatch cover mandrel assembly 91 and tightly pressed by an inner hatch cover screw 92 in FIG. 6; the intermediate hatch cover press plate 82 is connected to the hemispherical intermediate housing 3 via an intermediate hatch cover mandrel assembly 81 and tightly pressed by an intermediate hatch cover screw 83 in FIG. 5; and the outer hatch cover press plate 72 is connected to the hemispherical outer housing 6 via an outer hatch cover mandrel assembly 73 and tightly pressed by an outer hatch cover screw 71 in FIG. 4.

In order to ensure that the three hatch covers 192, 202, and 212 can be opened and closed smoothly, it is stipulated that diameters $L_1$, $L_2$, and $L_3$ of the inner hatch cover assembly 21, the intermediate hatch cover assembly 20, and the outer hatch cover assembly 19 meet the following proportional relationship: 1:1:2, the diameter of the inner hatch cover assembly 21 ranging from 0.7 m to 1.1 m.

As shown in FIGS. 1-3 and 7-9, an inner compartment inside the spherical inner housing A1 is connected to an external auxiliary submersible via an inner compartment hose and connector assembly 14, an inner hatch cover hose connector 101, and an outer hatch cover hose connector 121, so as to maintain a standard air pressure in the inner compartment inside the spherical inner housing A1. An intermediate compartment between the spherical inner housing A1 and the spherical intermediate housing B1 is connected to the external auxiliary submersible via an intermediate compartment hose and connector assembly 13, an intermediate hatch cover hose connector 111, and the outer hatch cover hose connector 121, so as to maintain a vacuum in the intermediate compartment between the spherical inner housing A1 and the spherical intermediate housing B1. An outer compartment between the spherical intermediate housing B1 and the spherical outer housing C1 is connected to the external auxiliary submersible via the outer hatch cover hose connector 121, so as to maintain an air pressure in the outer compartment between the spherical intermediate housing B1 and the spherical outer housing C1 at a half of a hydraulic pressure outside the submersible at its working depth.

Figure 7:
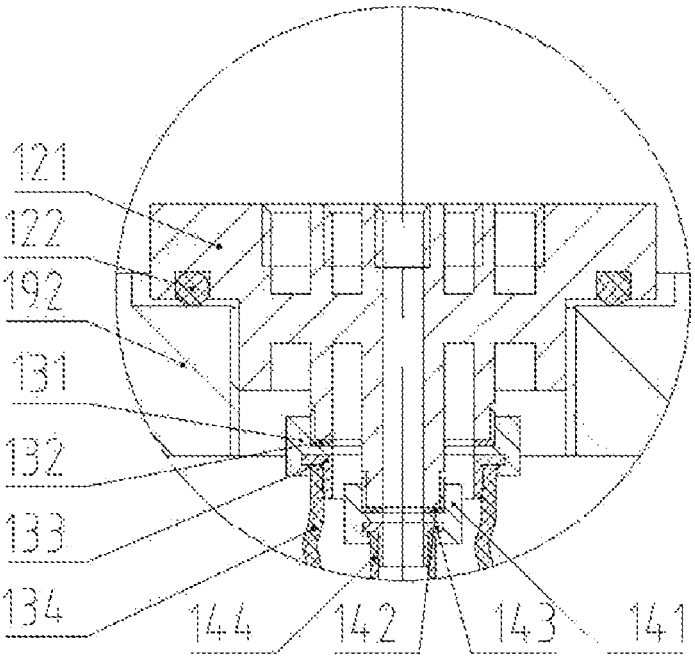
FIG. 7 is a partial enlarged sectional view of a three-tier nesting-mode outer hatch cover hose connector assembly 12 and a metal hose connector.
Figure 8:
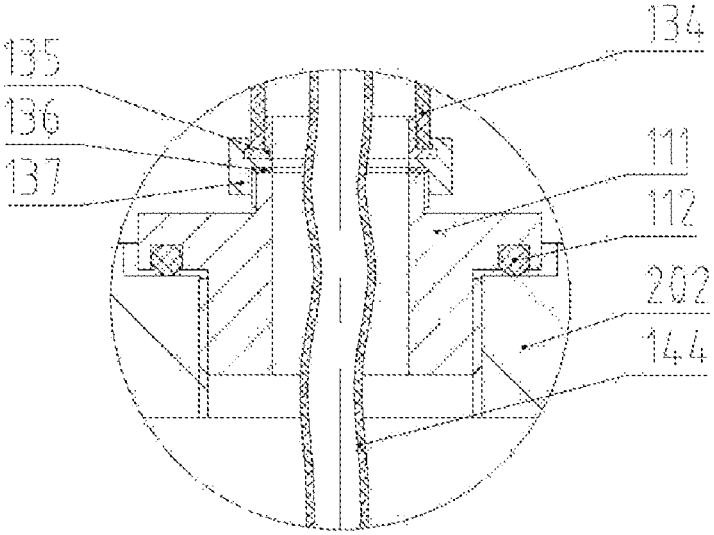
FIG. 8 is a partial enlarged sectional view of an intermediate hatch cover hose connector assembly 11 and a metal hose connector.
Figure 9:
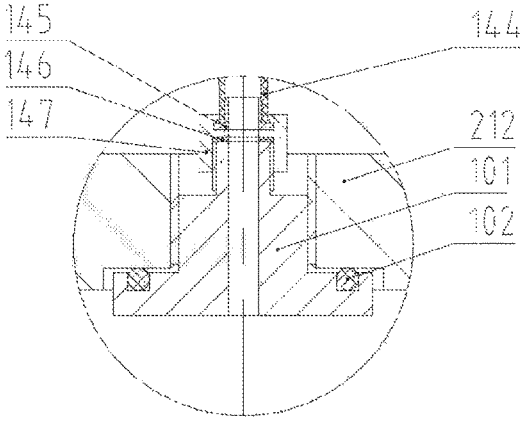
FIG. 9 is a partial enlarged sectional view of an inner hatch cover hose connector assembly 10 and a metal hose connector.

As shown in FIG. 7-9, the outer hatch cover hose connector 121 is a three-tier metal connector in a nesting mode, with inner, middle, and outer tiers being respectively connected to the inner, intermediate, and outer compartments. The inner compartment hose and connector assembly 14 for connecting an inner compartment hose 144 and the outer hatch cover hose connector 121 includes an inner compartment hose nut 141, an inner compartment hose seal ring 142, and an inner compartment hose sealing bush 143. The inner compartment hose and connector assembly 14 for connecting the inner compartment hose 144 and the inner hatch cover hose connector 101 includes an inner compartment hose sealing bush 145, an inner compartment hose seal ring 146, and an inner compartment hose nut 147. The intermediate compartment hose and connector assembly 13 for connecting an intermediate compartment hose 134 and the outer hatch cover hose connector 121 includes an intermediate compartment hose seal ring 132, an intermediate compartment hose sealing bush 133, and an intermediate compartment hose nut 131. The intermediate compartment hose and connector assembly 13 for connecting the intermediate compartment hose 134 and the intermediate hatch cover hose connector 111 includes an intermediate compartment hose sealing bush 135, an intermediate compartment hose seal ring 136, and an intermediate compartment hose nut 137. The three hatch cover hose connectors 101, 111, and 121 are all connected to the hatch covers 192, 202, and 212 through threads, and sealed by the O-shaped hatch cover hose connector seal rings 122, 112 and 102.

An assembly process of the present invention is as follows:

(1) Housings in Three Layers

A housing member in each layer is a hemispherical structure, and two hemispherical housings are connected via bolts or welded (a welding manner is used as an example in this embodiment) to form a complete spherical housing. During actual assembly of the housings in three layers, an inner hatch cover assembly 21 and other large-sized apparatuses are placed between the two hemispherical housings 1 and 2 of a spherical inner housing A1, and then the two hemispherical inner housings 1 and 2 of the spherical inner housing A1 are connected and welded to form a complete spherical inner housing A1.

Two connecting shafts 173 and 183 are symmetrically welded at two ends of the spherical inner housing A1, and then, slide bearings 177 and 187 smeared with lubricating grease are mounted on the two connecting shafts 173 and 183 respectively. Bearing press plates 174 and 184 are closed, and screws 175 and 185 are screwed into the bearing press plates 173 and 183. Slide bearing pedestals 172 and 182 are welded on inner walls of two hemispherical intermediate housings 3 and 4 of a spherical intermediate housing B1 respectively, and spring dampers 171 and 181 are mounted on outer sides of the slide bearing pedestals 172 and 182 respectively. Middle support plates 225 and 235 of rotary limiting buffers 22 and 23 between the spherical inner housing A1 and the spherical intermediate housing B1 are symmetrically welded on an outer wall of the spherical inner housing A1. Then, in each rotary limiting buffer 22 (or 23), one end of each of two hydraulic dampers 223, and 227 (or 233, and 237) with universal joints 222, 224, 226, and 228 (or 232, 234, 236, and 238) are welded to a corresponding middle support plate 225 (or 235), where the two ends are symmetrically arranged at two sides of the middle support plate 225 (or 235); and the other end is welded at one side of a corresponding upper support plate 221 (or 231) or lower support plate 229 (or 239). Two symmetrical semi-pedestals of upper support plate pedestal 2210 and lower support plate pedestal 2211 of the hydraulic dampers 223, and 227 (or 233, and 237) for connecting the spherical inner housing A1 and the spherical intermediate housing B1 are welded on rims of corresponding hemispherical intermediate housings 3 and 4 respectively. The two hemispherical intermediate housings 3 and 4 of the spherical intermediate housing B1 that carry upper support plate pedestal 2210 and lower support plate pedestal 2211 of the hydraulic dampers 223, and 227 (or 233, and 237), the slide bearing pedestals 172 and 182, and the spring dampers 171 and 181 are assembled at two sides of the spherical inner housing A1 with the intermediate connecting shafts 173 and 183. The intermediate connecting shafts 173 and 183 are made to be reliably fitted into inner holes of the slide bearing pedestals 172 and 182 via slide bearings 177 and 187 and a bearing bush assembly (inner bearing bush 176 and outer bearing bush 178, and inner bearing bush 186 and outer bearing bush 188). The upper support plate 221 (or 231) and lower support plate 229 (or 239) of the hydraulic dampers 223, and 227 (or 233, and 237) are clamped in two corresponding semi-pedestals respectively, and then the two hemispherical intermediate housings 3 and 4 of the spherical intermediate housing B1 are welded to form a complete spherical intermediate housing B1.

Two connecting shafts 153 and 163 are symmetrically welded at two ends of the spherical intermediate housing B1, and then, slide bearings 157 and 167 smeared with lubricating grease are mounted on the two connecting shafts 153 and 163 respectively. Bearing press plates 154 and 164 are closed, and screws 155 and 165 are screwed into the bearing press plates 154 and 164. Slide bearing pedestals 152 and 162 are welded on inner walls of two hemispherical outer housing 5 and 6 of a spherical outer housing C1 respectively, and spring dampers 151 and 161 are mounted on outer sides of the slide bearing pedestals 152 and 162 respectively. Middle support plates 245 and 255 of rotary limiting buffers 24 and 25 between the spherical intermediate housing B1 and the spherical outer housing C1 are symmetrically welded on an outer wall of the spherical intermediate housing B1. Then, in each rotary limiting buffer 24 (or 25), one end of each of two hydraulic dampers 243 and 247 (or 253 and 257) with universal joints 242, 244, 246, and 248 (or 242, 244, 246, and 248) is welded to a corresponding middle support plate 245 (or 255), where the two ends are symmetrically arranged at two sides of the middle support plate 245 (or 255); and the other end is welded at one side of a corresponding upper support plate 241 (or 251) or lower support plate 249 (or 259). Two symmetrical semi-pedestals of upper support plate pedestal 2410 and lower support plate pedestals 2411 of the hydraulic dampers 243 and 247 (or 253 and 257) for connecting the spherical intermediate housing B1 and the spherical outer housing C1 are welded on rims of corresponding hemispherical outer housings 5 and 6 respectively. The two hemispherical outer housing 5 and 6 of the spherical outer housing C1 that carry upper support plate pedestal 2410 and lower support plate pedestal 2411 of the hydraulic dampers 243 and 247 (or 253 and 257), the slide bearing pedestals 152 and 162, and the spring dampers 151 and 161 are assembled at two sides of the spherical intermediate housing B1 with the connecting shafts 153 and 163. The connecting shafts 153 and 163 are made to be reliably fitted into inner holes of the slide bearing pedestals 152 and 162 via slide bearings 157 and 167 and a bearing bush assembly (inner bearing bush 156 and outer bearing bush 158, and inner bearing bush 166 and outer bearing bush 168). The upper support plate 241 (or 251) and lower support plates 249 (or 259) of the hydraulic dampers 243 and 247 (or 253 and 257) are clamped in two corresponding semi-pedestals respectively, and then the two hemispherical outer housings 5 and 6 of the spherical outer housing C1 are welded to form a complete spherical outer housing C1.

(2) Hatch Covers in Three Layers

During actual assembly of hatch covers 212, 202, and 192 in inner, middle and outer layers and corresponding hatch cover press plate assemblies 9, 8, and 7, hatch cover seal rings 211, 201, and 191 of the three hatch covers 212, 202, and 192 are first mounted. The inner hatch cover 212 that has been placed into the inner compartment is mounted on the spherical inner housing A1 via an inner hatch cover connecting pin-shaft assembly 213. An inner hatch cover press plate 93 is mounted on an inner hatch cover mandrel assembly 91 of the inner hatch cover press plate 93, and then the shaft ends are clamped via retainer rings. After the inner hatch cover 212 is closed, an inner hatch cover screw 92 is screwed into the inner hatch cover press plate 93. The intermediate hatch cover 202 is mounted on the spherical intermediate housing B1 via an intermediate hatch cover connecting pin-shaft assembly 203. An intermediate hatch cover press plate 82 is mounted on an intermediate hatch cover mandrel assembly 81 of the intermediate hatch cover press plate 82, and then the shaft ends are clamped via retainer rings. After the intermediate hatch cover 202 is closed, an intermediate hatch cover screw 83 is screwed into the intermediate hatch cover press plates 82. The outer hatch cover 192 is mounted on the spherical outer housing C1 via an outer hatch cover connecting pin-shaft assembly 193. An outer hatch cover press plate 72 is mounted on an outer hatch cover mandrel assembly 73 of the outer hatch cover press plate 72, and then shaft ends are clamped via retainer rings. After the outer hatch cover 192 is closed, an outer hatch cover screw 71 is screwed into the outer hatch cover press plates 72.

(3) Pipelines in Three Layers

During actual assembly of gas filling and exhaust pipelines and corresponding connectors, seal rings of hatch cover hose connectors in the three layers are mounted on corresponding hose connectors. The inner hatch cover hose connector 101, the intermediate hatch cover hose connector 111 and the outer hatch cover hose connector 121 are respectively mounted on the corresponding inner hatch cover 212, intermediate hatch cover 202 and outer hatch cover 192, and are screwed. The inner compartment hose and connector assembly 14 runs through the intermediate compartment hose and connector assembly 13 and the intermediate hatch cover hose connector 111. Two connectors of the inner compartment hose 144 are respectively screwed onto the inner hatch cover hose connector 101 and the outer hatch cover hose connector 121. Two connectors of the intermediate compartment hose 134 are respectively screwed onto the intermediate hatch cover hose connector 111 and the outer hatch cover hose connector 121.

What is claimed is:

1. A self-balancing pressure hull device, assembled by successively nesting, from inside to outside, a spherical inner housing, a spherical intermediate housing and a spherical outer housing around the sphere center, two pairs of connecting shaft assemblies symmetric and coaxial to each other, one pair of the connecting shaft assemblies being connected between the spherical inner housing and the spherical intermediate housing and the other pair of the connecting shaft assemblies being connected between the spherical intermediate housing and the spherical outer housing;

axes of the two pairs of connecting shaft assemblies being perpendicular to each other so as to enable the spherical inner housing and the spherical intermediate housing to rotate relative to each other, and the spherical intermediate housing and the spherical outer housing to rotate relative to each other, and each of the connecting shaft assemblies in the two pairs of the connecting shaft assemblies being provided with a spring damper for resisting an axial impact between each two adjacent housings, wherein the spherical inner housing is formed by connecting a first hemispherical inner housing and a second hemispherical inner housing, the spherical intermediate housing is formed by connecting a first hemispherical intermediate housing and a second hemispherical intermediate housing, and the spherical outer housing is formed by connecting a first hemispherical outer housing and a second hemispherical outer housing;

two pairs of rotary limiting buffers symmetric to each other are provided between the spherical inner housing and the spherical intermediate housing and between the spherical intermediate housing and the spherical outer housing, respectively;

a connecting line of the rotary limiting buffers between the spherical inner housing and the spherical intermediate housing is perpendicular to an axis of the pair of the connecting shaft assemblies between the spherical inner housing and the spherical intermediate housing; and a connecting line of the rotary limiting buffers between the spherical intermediate housing and the spherical outer housing is perpendicular to an axis of the pair of the connecting shaft assemblies between the spherical intermediate housing and the spherical outer housing;

the spherical inner housing is provided with an inner hatch cover assembly, the spherical intermediate housing is provided with an intermediate hatch cover assembly, and the spherical outer housing is provided with an outer hatch cover assembly, the inner hatch cover assembly, the intermediate hatch cover assembly, and the outer hatch cover assembly being each disposed with a circular hatch cover;

an inner hatch cover is connected to an inner wall of the spherical inner housing via an inner hatch cover connecting pin-shaft, tightly pressed by an inner hatch cover press plate mounted on the inner wall of the spherical inner housing, and sealed by an inner hatch cover seal ring;

an intermediate hatch cover is connected to an outer wall of the spherical intermediate housing via an intermediate hatch cover connecting pin-shaft, tightly pressed by an intermediate hatch cover press plate mounted on the outer wall of the spherical intermediate housing, and sealed by an intermediate hatch cover seal ring;

an outer hatch cover is connected to an outer wall of the spherical outer housing via an outer hatch cover connecting pin-shaft, tightly pressed by an outer hatch cover press plate mounted on the outer wall of the spherical outer housing, and sealed by an outer hatch cover seal ring; and an inner hatch cover hose connector is connected to an outer hatch cover hose connector via an inner compartment hose and connector assembly to connect an inner compartment inside the spherical inner housing with an external auxiliary submersible, so as to maintain a standard air pressure in the inner compartment inside the spherical inner housing;

an intermediate hatch cover hose connector is connected to the outer hatch cover hose connector via an intermediate compartment hose and connector assembly to connect an intermediate compartment between the spherical inner housing and the spherical intermediate housing with the external auxiliary submersible, so as to maintain a vacuum in the intermediate compartment between the spherical inner housing and the spherical intermediate housing; and an outer compartment between the intermediate housing and the outer housing is connected to the external auxiliary submersible via the outer hatch cover hose connector, so as to maintain an air pressure in the outer compartment between the spherical intermediate housing and the spherical outer housing at a half of a hydraulic pressure outside the self-balancing pressure hull device at its working depth, the outer hatch cover hose connector being a three-tier metal connector in a nesting mode, with inner, middle, and outer tiers being respectively connected to the inner, intermediate, and outer compartments via metal hoses; and the inner hatch cover hose connector, the intermediate hatch cover hose connector and the outer hatch cover hose connector being respectively connected to the inner hatch cover, the intermediate hatch cover and the outer hatch cover through threads and sealed by seal rings.

2. The self-balancing pressure hull device according to claim 1, wherein the pair of the connecting shaft assemblies between the spherical intermediate housing and the spherical outer housing are of the same structure and size, and each connecting shaft assembly comprises a spring damper, a slide bearing pedestal, a connecting shaft, a slide bearing, an inner bearing bush, an outer bearing bush, a bearing press plate, and a screw, the slide bearing being fixed on the connecting shaft via the bearing press plate and the screw; the inner bearing bush being disposed between an inner wall of the slide bearing and the connecting shaft; the connecting shaft being supported on the outer wall of the spherical intermediate housing; the slide bearing pedestal being supported on the inner wall of the spherical outer housing; the outer bearing bush being disposed between an outer wall of the slide bearing and the slide bearing pedestal; and the spring damper being mounted on an outer side of the slide bearing pedestal, with two ends being tightly pressed against the connecting shaft and a protrusion of the slide bearing pedestal respectively; and the pair of the connecting shaft assemblies between the spherical inner housing and the spherical intermediate housing are of the same structure and size, and each connecting shaft assembly comprises a spring damper, a slide bearing pedestal, a connecting shaft, a slide bearing, an inner bearing bush, an outer bearing bush, a bearing press plate, and a screw, the slide bearing being fixed on the connecting shaft via the bearing press plate and the screw; the inner bearing bush being disposed between an inner wall of the slide bearing and the connecting shaft; the connecting shaft being supported on the outer wall of the spherical inner housing; the slide bearing pedestal being supported on the inner wall of the spherical intermediate housing; the outer bearing bush being disposed between an outer wall of the slide bearing and the slide bearing pedestal; and the spring damper being mounted on an outer side of the slide bearing pedestal, with two ends being tightly pressed against the connecting shaft and a protrusion of the slide bearing pedestal respectively.

3. The self-balancing pressure hull device according to claim 1, wherein the pair of the rotary limiting buffers between the spherical inner housing and the spherical intermediate housing are of the same structure and size, and each rotary limiting buffer comprises an upper support plate, a middle support plate, a lower support plate, an upper hydraulic damper, and a lower hydraulic damper, the middle support plate being welded to the outer wall of the spherical inner housing; the upper support plate and the lower support plate being respectively disposed on an upper support plate pedestal and a lower support plate pedestal which are connected to the inner wall of the spherical intermediate housing; the upper hydraulic damper and the lower hydraulic damper being symmetrically arranged about the middle support plate; one end of each of the upper hydraulic damper and the lower hydraulic damper being connected to the middle support plate via a universal joint; the other end of the upper hydraulic damper being connected to the upper support plate via a universal joint; and the other end of the lower hydraulic damper being connected to the lower support plate via a universal joint; and the pair of the rotary limiting buffers between the spherical intermediate housing and the spherical outer housing are of the same structure and size, and each rotary limiting buffer comprises an upper support plate, a middle support plate, a lower support plate, an upper hydraulic damper, and a lower hydraulic damper, the middle support plate being welded to the outer wall of the spherical intermediate housing; the upper support plate and the lower support plate being respectively disposed on an upper support plate pedestal and a lower support plate pedestal which are connected to the inner wall of the spherical outer housing; the upper hydraulic damper and the lower hydraulic damper being symmetrically arranged about the middle support plate; one end of each of the upper hydraulic damper and the lower hydraulic damper being connected to the middle support plate via a universal joint; the other end of the upper hydraulic damper being connected to the upper support plate via a universal joint; and the other end of the lower hydraulic damper being connected to the lower support plate via a universal joint.

4. The self-balancing pressure hull device according to claim 1, wherein the inner hatch cover press plate is connected to the spherical inner housing via an inner hatch cover mandrel assembly and tightly pressed by an inner hatch cover screw; the intermediate hatch cover press plate is connected to the spherical intermediate housing via an intermediate hatch cover mandrel assembly and tightly pressed by an intermediate hatch cover screw assembly; and the outer hatch cover press plate is connected to the spherical outer housing via an outer hatch cover mandrel assembly and tightly pressed by an outer hatch cover screw assembly.

5. The self-balancing pressure hull device according to claim 1, wherein diameters D1, D2, and D3 of the spherical inner housing, the spherical intermediate housing and the spherical outer housing meet the following proportional relationship: 2:3:4, the diameter of the spherical inner housing ranging from 2.2 m to 3.1 m.

6. The self-balancing pressure hull device according to claim 5, wherein diameters L1, L2, and L3 of the inner hatch cover, the intermediate hatch cover and the outer hatch cover meet the following proportional relationship: 1:1:2, the diameter of the inner hatch cover ranging from 0.7 m to 1.1 m.

7. The self-balancing pressure hull device according to claim 3, wherein the upper support plate pedestal and the lower support plate pedestal in each rotary limiting buffer are two symmetric semi-pedestals, the two semi-pedestals being welded to rims of corresponding hemispherical housings of the spherical inner housing, the spherical intermediate housing or the spherical outer housing respectively; and after the two hemispherical housings are assembled into a complete spherical housing, the upper support plate and the lower support plate are clamped in the two corresponding semi-pedestals respectively.

8. The self-balancing pressure hull device according to claim 1, wherein a counterweight is placed on each of the bottoms of the spherical inner housing, the spherical intermediate housing and the spherical outer housing.

9. The self-balancing pressure hull device according to claim 2, wherein the slide bearing in each connecting shaft assembly is an integral self-lubricating bearing.

10. The self-balancing pressure hull device according to claim 2, wherein the spring damper in each connecting shaft assembly is replaced with a rubber damper.

11. The self-balancing pressure hull device according to claim 2, wherein the inner hatch cover press plate is connected to the spherical inner housing via an inner hatch cover mandrel assembly and tightly pressed by an inner hatch cover screw; the intermediate hatch cover press plate is connected to the spherical intermediate housing via an intermediate hatch cover mandrel assembly and tightly pressed by an intermediate hatch cover screw; and the outer hatch cover press plate is connected to the spherical outer housing via an outer hatch cover mandrel assembly and tightly pressed by an outer hatch cover screw assembly.

12. The self-balancing pressure hull device according to claim 3, wherein the inner hatch cover press plate is connected to the spherical inner housing via an inner hatch cover mandrel assembly and tightly pressed by an inner hatch cover screw; the intermediate hatch cover press plate is connected to the spherical intermediate housing via an intermediate hatch cover mandrel assembly and tightly pressed by an intermediate hatch cover screw assembly; and the outer hatch cover press plate is connected to the spherical outer housing via an outer hatch cover mandrel assembly and tightly pressed by an outer hatch cover screw assembly.

13. The self-balancing pressure hull device according to claim 2, wherein diameters D1, D2, and D3 of the spherical inner housing, the spherical intermediate housing and the spherical outer housing meet the following proportional relationship: 2:3:4, the diameter of the spherical inner housing ranging from 2.2 m to 3.1 m.

14. The self-balancing pressure hull device according to claim 13, wherein diameters L1, L2, and L3 of the inner hatch cover, the intermediate hatch cover and the outer hatch cover meet the following proportional relationship: 1:1:2, the diameter of the inner hatch cover ranging from 0.7 m to 1.1 m.

15. The self-balancing pressure hull device according to claim 3, wherein diameters D1, D2, and D3 of the spherical inner housing, the spherical intermediate housing and the spherical outer housing meet the following proportional relationship: 2:3:4, the diameter of the spherical inner housing ranging from 2.2 m to 3.1 m.

16. The self-balancing pressure hull device according to claim 15, wherein diameters L1, L2, and L3 of the inner hatch cover, the intermediate hatch cover and the outer hatch cover meet the following proportional relationship: 1:1:2, the diameter of the inner compartment hatch ranging from 0.7 m to 1.1 m.

17. The self-balancing pressure hull device according to claim 2, wherein a counterweight is placed on each of the bottoms of the spherical inner housing, the spherical intermediate housing and the spherical outer housing.

18. The self-balancing pressure hull device according to claim 3, wherein a counterweight is placed on each of the bottoms of the spherical inner housing, the spherical intermediate housing and the spherical outer housing.

* * * * *